US006116993A

United States Patent [19]

Tanaka

[11] Patent Number: 6,116,993

[45] Date of Patent: Sep. 12, 2000

[54] CHEMICOMECHANICAL POLISHING DEVICE FOR A SEMICONDUCTOR WAFER

[75] Inventor: Morimitsu Tanaka, Tokyo, Japan

[73] Assignee: NEC Corporation, Tokyo, Japan

[21] Appl. No.: 08/932,319

[22] Filed: Sep. 17, 1997

[30] Foreign Application Priority Data

Sep. 20, 1996 [JP] Japan ..... 8-250116

[51] Int. Cl.[7] ..... B24B 5/00; B24B 29/00

[52] U.S. Cl. ..... 451/287; 451/446

[58] Field of Search ..... 451/285, 287, 451/288, 63, 28, 41, 42, 60, 56, 443, 446, 397, 398

[56] References Cited

U.S. PATENT DOCUMENTS

| | | | |
|---|---|---|---|
| 5,433,650 | 7/1995 | Winebarger | 451/287 |
| 5,578,529 | 11/1996 | Mullins | 451/287 |
| 5,584,749 | 12/1996 | Mitsuhashi et al. | 451/287 |
| 5,649,849 | 7/1997 | Pileri et al. | 451/285 |
| 5,651,725 | 7/1997 | Kikuta et al. | 451/287 |
| 5,664,990 | 9/1997 | Adams et al. | 451/287 |
| 5,665,656 | 9/1997 | Jairath | 451/287 |
| 5,672,095 | 9/1997 | Morimoto et al. | 451/287 |
| 5,709,593 | 1/1998 | Guthrie et al. | 451/446 |

*Primary Examiner*—Derris H. Banks
*Attorney, Agent, or Firm*—Laff, Whitesel & Saret, Ltd.; J. Warren Whitesel

[57] ABSTRACT

A chemicomechanical polishing (CMP) apparatus for polishing a semiconductor wafer of the present invention includes a polishing pad and a wafer carrier disposed above the pad. A slurry feed port is positioned upstream of, but in the vicinity of, the wafer carrier in the direction of rotation of the polishing pad. Slurry is fed to the wafer supported by the wafer carrier via the slurry feed port. A slurry removing device is positioned downstream of the wafer carrier in the above direction. A conditioning mechanism for conditioning the pad is interposed between the wafer carrier and the slurry removing device.

6 Claims, 3 Drawing Sheets

CHEMICOMECHANICAL POLISHING DEVICE FOR A SEMICONDUCTOR WAFER

BACKGROUND OF THE INVENTION

The present invention relates to a semiconductor device production line and, more particularly, to a chemicomechanical polishing (CMP hereinafter) apparatus for polishing material layers formed an a semiconductor substrate.

Advances in the integration of semiconductor devices have led to the lamination of semiconductor substrates. Planarization technologies mainly directed toward interlayer insulating films are the key to the lamination of a semiconductor substrate. Among them, a planarization technology using a CMP apparatus is attracting increasing attention due to the progress of integration of semiconductor devices.

A conventional CMP apparatus includes a polishing platen and a polishing pad provided on the platen. While a slurry is fed to the polishing pad, a wafer is pressed against the pad. As a result, films formed on the wafer and including interlayer insulating films are polished.

However, the conventional CMP apparatus has some problems left unsolved, as follows. The slurry is dropped onto the center of the polishing pad and then spread away from the center simply by a centrifugal force. This prevents the slurry from being evenly fed to the interface between the wafer and the pad in a sufficient amount. As a result, each wafer cannot be evenly polished or cannot be polished at the same rate as the other wafers.

The polishing pad is formed of foam urethane or similar porous material having numerous projections and recesses on its surface. This, coupled with the fact that the slurry has some viscosity, prevents the slurry used to polish the wafer from being sufficiently removed by a centrifugal force available with the rotation of a conventional polishing platen. Consequently, the used slurry containing polishing waste remains on the polishing pad and scratches the next wafer.

The projections and recess of the polishing pad sequentially decrease due to repeated operation, resulting in a decrease in polishing rate. To preserve a desired polishing rate, it has been customary to condition the surface of the pad, i.e., to scan the pad with a conditioning disk while rotating the pad and feeding the slurry to the pad. The conditioning disk has diamond grains of 100 $\mu m^2$ buried therein. However, sore of the diamond chips come off the disk during conditioning and remain on the pad, scratching the surfaces of wafers to be polished.

Devices for polishing the surface of a semiconductor wafer are taught in, e.g., Japanese Patent Laid-Open Publication Nos. 5-13389 and 7-111256.

SUMMARY OF THE INVENTION

It is therefore an object of the present invention to provide a CMP apparatus capable of feeding a sufficient amount of fresh slurry evenly to the interface between a polishing pad and a wafer, and effectively removing used slurry from the polishing pad.

In accordance with the present invention, a CMP apparatus for chemicomechanically polishing the surface of a semiconductor wafer has a polishing pad rotatable for polishing the surface of the wafer, a wafer carrier for rotatably supporting the wafer, and a slurry feed port positioned upstream of the wafer carrier in the direction of rotation of the polishing pad for feeding slurry to the polishing pad.

Also, in accordance with the present invention, a CMP apparatus for chemicomechanically polishing the surface of a semiconductor wafer has a polishing pad rotatable for polishing the surface of the wafer, a wafer carrier for rotatably supporting the wafer, and a slurry removing device positioned downstream of the wafer carrier in the direction of rotation of the polishing pad for removing slurry fed to the polishing pad and used,

BRIEF DESCRIPTION OF THE DRAWINGS

The above and other objects, features and advantages of the present invention will become apparent from the following detailed description taken with the accompanying drawings in which.

Figure 1A:
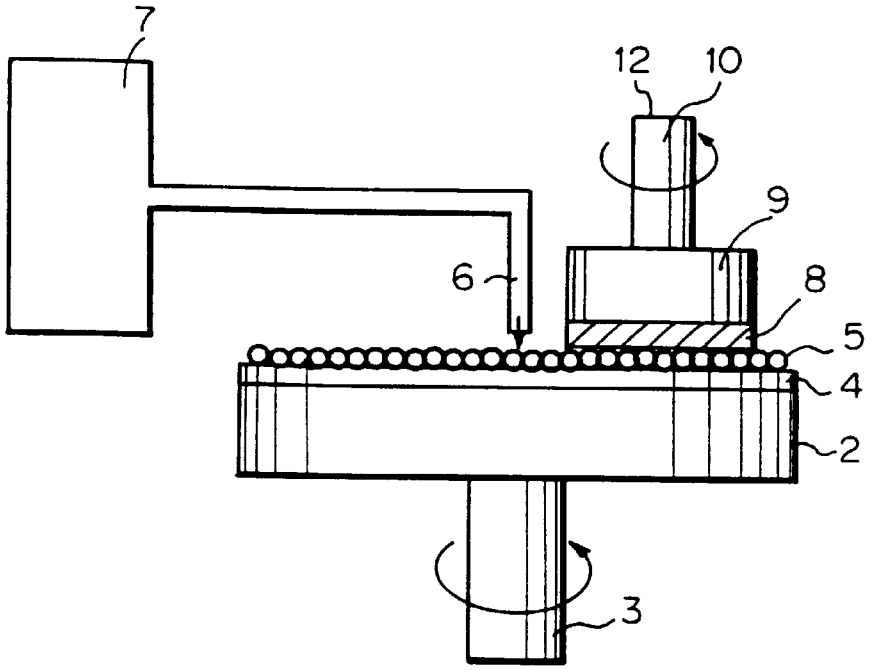
Fig. 1A PRIOR ART
FIGS. 1A and 1B are respectively a side elevation and a plan view showing a conventional CMP apparatus.

In the drawings, identical references denote identical structural elements.

DESCRIPTION Of THE PREFERRED EMBODIMENTS

Figure 1B:
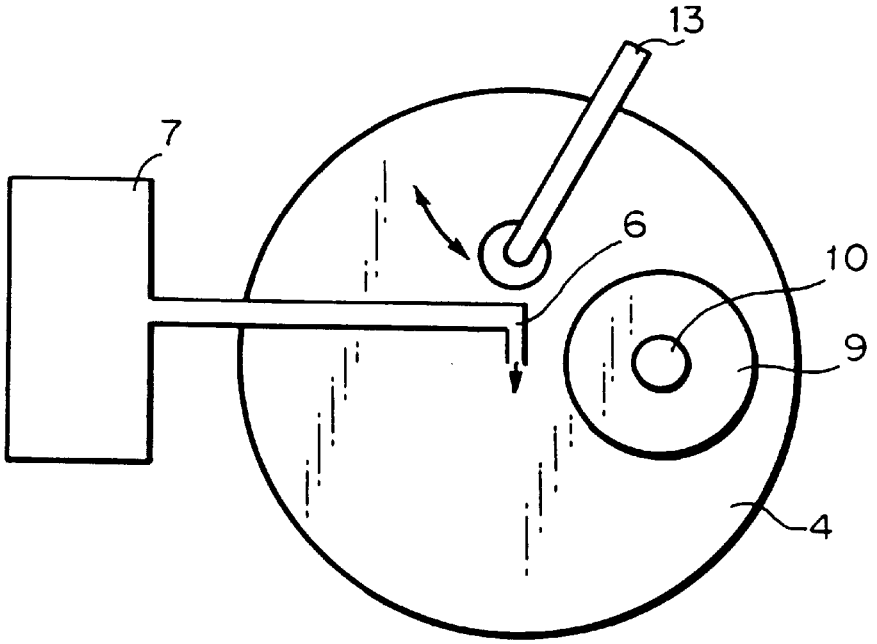
Fig. 1B PRIOR ART

To better understand the present invention, brief reference will be made to a conventional CMP apparatus, shown in FIGS. 1A and 1B. As shown, the CMP apparatus includes a polishing platen 2 mounted on a rotary shaft 3. A polishing pad 4 is provided on the surface of the polishing platen 2 and formed of a porous material having continuous pores. A wafer carrier 9 is mounted on another rotary shaft 10 and supports a wafer 8 to be polished. A slurry feeder 7 feeds slurry 5 to the polishing pad 4 via a tubing 6. A conditioning mechanism 13 conditions the surface of the polishing pad 4. A mechanism 12 is associated with the rotary shaft 10 for adjusting the pressure pressing the wafer 8 against the polishing pad 4.

In operation, while the slurry 5 is fed to the pad 4 being rotated by the shaft 3, the wafer 8 being rotated by the shaft 10 via the wafer carrier 9 is brought into contact with the pad 4. In this condition, the pad 4 having fine holes polishes films formed on the wafer 8 and including interlayer insulating films.

A problem with the above configuration is that the slurry 5 cannot be sufficiently or evenly fed to the interface between the wafer 8 and the polishing pad 4, as stated earlier. This prevents the wafer 8 from being evenly polished and prevents all the wafers from being polished at the same rate. Another problem is that the slurry 5 which polished the wafer 8 cannot be fully removed from the pad 4, i.e., the used slurry 5 containing waste remains on the pad 4 and scratches the surface of the next wafer 8. Still another problem is that because the surface of the pad 4 is conditioned for the previously stated purpose, dropped diamond grains remain on the pad 4 and scratch the surface of the wafer 8.

Preferred embodiments of the CMP apparatus in accordance with the present invention will be described hereinafter. Briefly, in the embodiments to be described, a slurry feed port is positioned upstream of a wafer carrier with respect to the direction of rotation of a polishing platen while a slurry removing device is positioned downstream of the wafer carrier in the above direction.

Figure 2A:
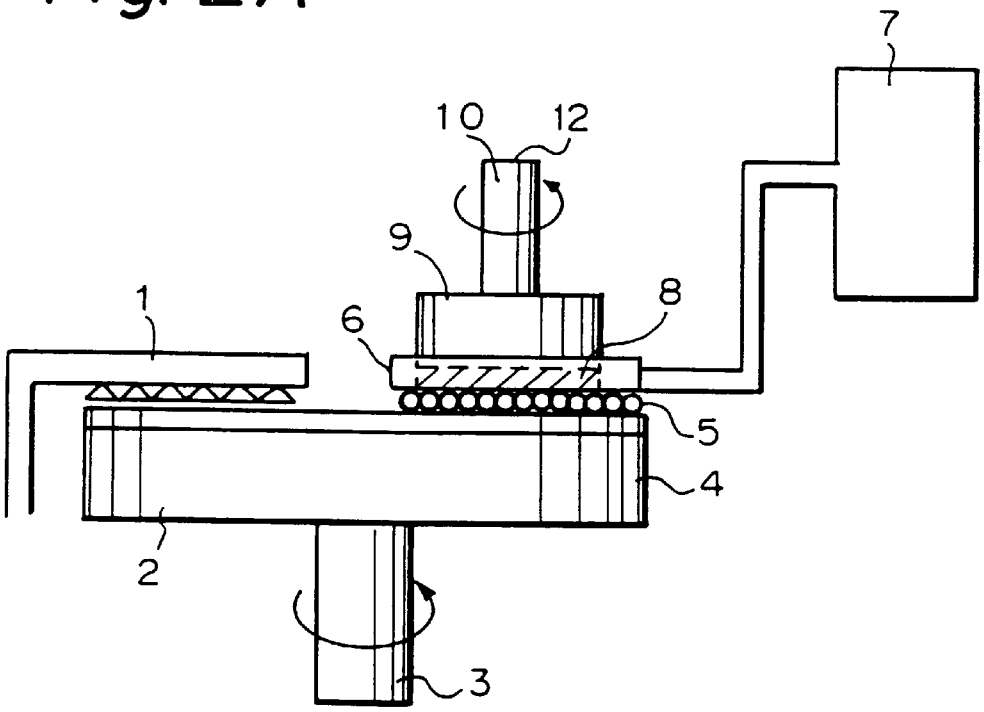
FIGS. 2A and 2B are respectively a side elevation and a plan view showing a CMP apparatus embodying the present invention.
Figure 2B:
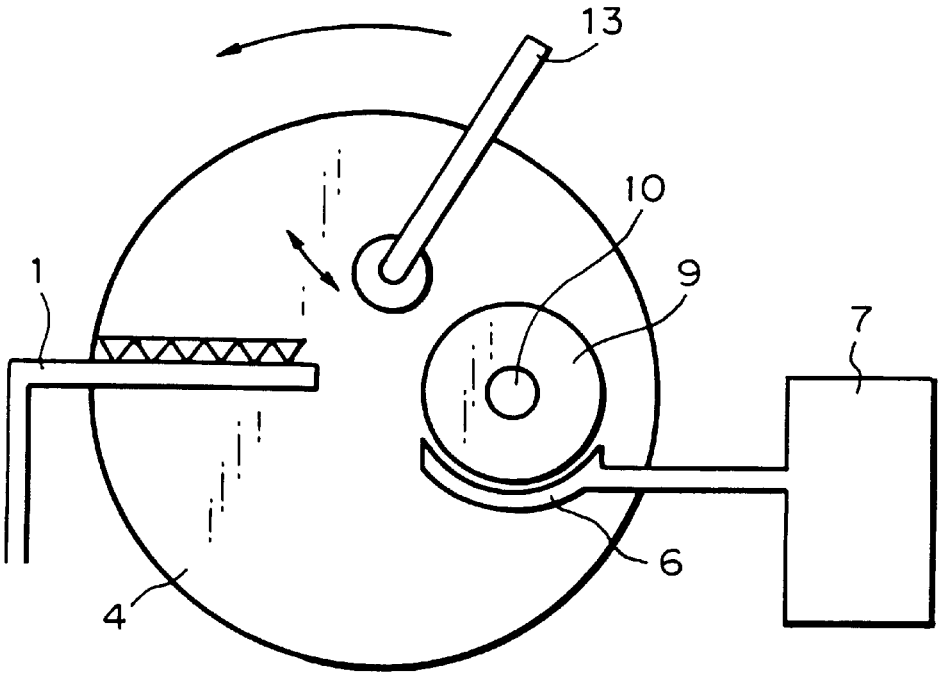

Referring to FIGS. 2A and 2B, a CMP apparatus embodying the present invention is shown and includes an arcuate tubing or port 6 for feeding a slurry 5 to a wafer 8 carried on a wafer carrier 9. The tubing 6 is positioned upstream of the wafer carrier 9 in the direction of rotation of a polishing platen 2. A shower 1 is positioned downstream of the wafer carrier 9 in the above direction. The shower 1 cleans a polishing pad 4 by feeding pure water from above the pad 4. A conditioning mechanism 13 is positioned between the wafer carrier 9 and the shower 1. The tubing 6 should preferably extend in the vicinity of the wafer carrier 9 in an arcuate configuration in order to efficiently feed the slurry 5 to the wafer 8. In addition, the shower 1 should preferably be provided with a number of nozzles for efficiently removing the used slurry 5 from the pad 4.

The CMP apparatus having the above construction was operated to polish P—$S_iO_2$ formed on wafers by CVD (Chemical Vapor Deposition) Polishing conditions were as follows:

Speed of plate 2: 20 rpm (revolutions per minute)

Speed of wafer carrier 9: 20 rpm

Pressure: 7 psi (pounds per square inch)

Flow rate of slurry 5: 100 cc/min

Flow rate pure water: 10 l/min

Temperature of pad 4: 25° C.

The CMP apparatus was found to stabilize the polishing rate of P—$S_iO_2$ and to enhance even polishing. In addition, the CMP apparatus noticeably reduced the scratches of P—$S_iO_2$.

Figure 3A:
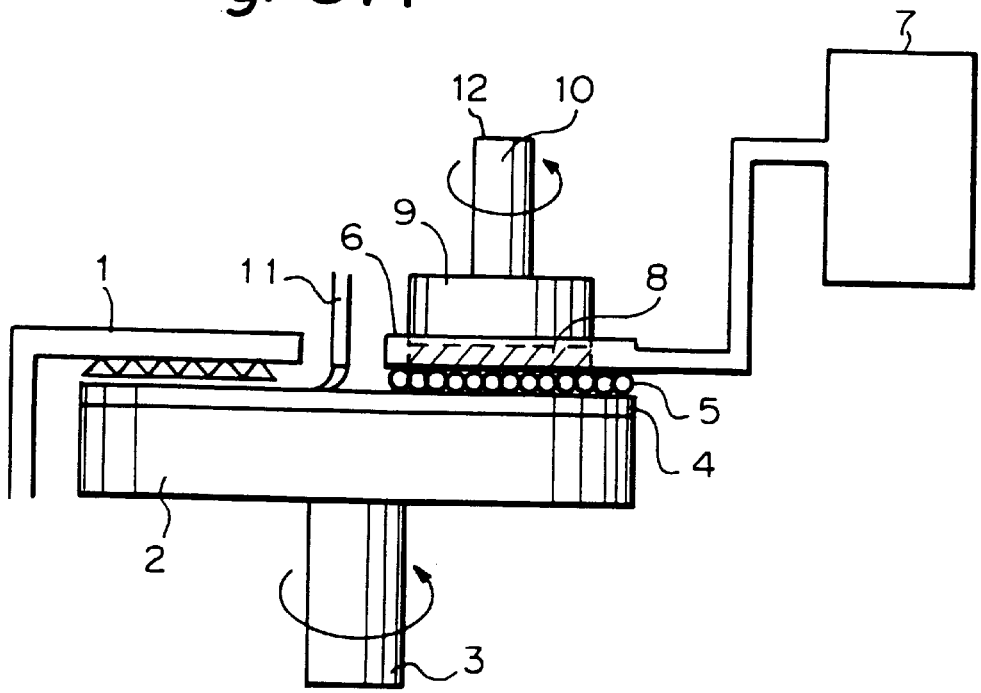
FIG. 3A and 3B are respectively a side elevation and a plan view showing an alternative embodiment of the present invention.
Figure 3B:
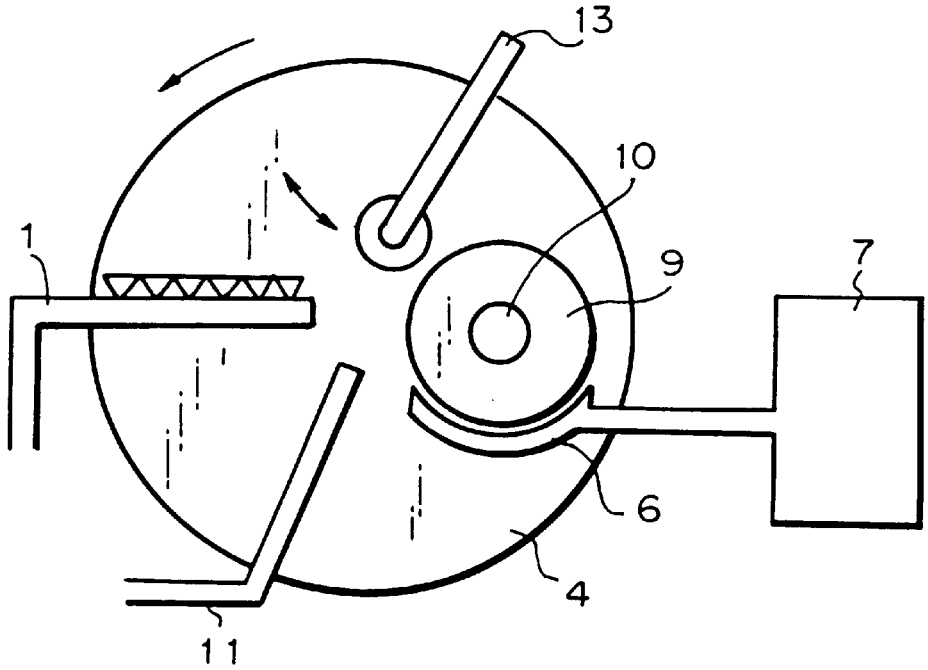

An alternative embodiment of the present invention will be described with reference to FIGS. 3A and 3B. As shown, this embodiment additionally includes a water removing plate 11 which may be implemented as a water suction device or a heater for evaporation. The water removing plate 11 is held in contact with the polishing pad 4 in order to promote the efficient removal of water from the pad 4.

The alternative embodiment was also operated to polish P—SiO2 formed on wafers under the same conditions as the previous embodiment. The alternative embodiment was found to be comparable with the previous embodiment as to effects.

Another alternative embodiment of the present invention, although not shown specifically, is identical with the embodiment shown in FIGS. 2A and 2D except that the shower 1 is replaced with a slurry suction port positioned downstream of the wafer carrier 9 in the direction of rotation of the polishing platen 2. The slurry suction port sucks the used slurry 5 existing on the polishing pad 4.

In summary, it will be seen that the present invention provides a CMP apparatus for a semiconductor wafer and having various unoprecedented advantages, as enumerated below.

(1) A slurry feed port is positioned upstream of a wafer carrier in the direction of rotation of a polishing platen, so that fresh slurry can be efficiently conveyed to the interface between a polishing pad and a wafer by the polishing platen. Because fresh slurry is constantly fed to the above interface in a sufficient amount, there can be reduce the uneven polishing of a wafer and the difference in polishing rate between wafers.

(2) Used slurry and diamond grains separated during conditioning are successfully removed from the polishing pad and prevented from scratching the surfaces of wafers.

(3) Because the used slurry does not stay on the polishing pad, waste resulting from polishing is prevented from filling up the fine gaps of the surface of the polishing pad.

Various modifications will become possible for those skilled in the art after receiving the teachings of the present disclosure without departing from the scope thereof.

What is claimed is:

1. A CMP apparatus for chemicomechanically polishing a surface of a semiconductor wafer, comprising:

a rotatable polishing pad for polishing the surface of the wafer;

a wafer carrier for rotatably supporting the wafer; said wafer havng an arcuate peripheral contour; and a slurry feed port positioned upstream of said wafer carrier in a direction of rotation of said polishing pad for feeding slurry to said polishing pad, said slurry feed port extending adjacent and along said contour at the peripheral of the wafer; wherein said contour is arcuate and said slurry feeding port extends arcuately along the contour of the wafer.

2. A CMP apparatus as claimed in claim 1, further comprising a slurry removing device positioned downstream of wafer carrier in the direction of rotation of said polishing pad.

3. A CMP apparatus as claimed in claim 2, wherein said slurry removing device comprises a device for sucking the slurry.

4. A CMP apparatus as claimed in claim 2, wherein said slurry removing device comprises a pure water shower.

5. A CMP apparatus as claimed in claim 4, further comprising a water removing plate positioned downstream of said pure water shower in the direction of rotation of said polishing pad.

6. A CMP apparatus as claimed in claim 2, wherein said polishing pad is conditioned at a position between said wafer carrier and said slurry removing device.

* * * * *